US011510511B2

(12) United States Patent
Wright

(10) Patent No.: US 11,510,511 B2
(45) Date of Patent: Nov. 29, 2022

(54) LIGHTWEIGHT, COMPACT, BEACH TOWEL ASSEMBLY

(71) Applicant: David Wright, Oak Hills, CA (US)

(72) Inventor: David Wright, Oak Hills, CA (US)

( * ) Notice: Subject to any disclaimer, the term of this patent is extended or adjusted under 35 U.S.C. 154(b) by 87 days.

(21) Appl. No.: 17/164,484

(22) Filed: Feb. 1, 2021

(65) Prior Publication Data

US 2022/0240696 A1 Aug. 4, 2022

(51) Int. Cl.
*A47G 9/06* (2006.01)

(52) U.S. Cl.
CPC ..... *A47G 9/062* (2013.01)

(58) Field of Classification Search
CPC ..... A47G 9/06; A47G 9/062
See application file for complete search history.

(56) References Cited

U.S. PATENT DOCUMENTS 3,226,737 A * 1/1966 William ..... E04H 15/56 135/120.1
5,018,229 A * 5/1991 Eberhart ..... A47G 9/062 428/100
5,406,659 A * 4/1995 Camp ..... A47G 9/062 52/3
5,499,411 A * 3/1996 Wong ..... A47G 9/062 5/417
5,520,364 A * 5/1996 Bloxson ..... A47G 9/062 248/500
6,073,283 A * 6/2000 Zheng ..... A47G 9/062 5/502
11,178,987 B2 * 11/2021 Novacek ..... A47G 9/062
11,229,304 B2 * 1/2022 Paulat ..... A47G 9/06
2005/0005355 A1 * 1/2005 Marks ..... A47G 9/062 5/417
2006/0024471 A1 * 2/2006 Cunningham ..... A47G 9/062 428/81
2010/0017960 A1 * 1/2010 Blaauboer ..... A47G 9/062 5/417
2017/0112300 A1 * 4/2017 Paulat ..... A47G 9/062

* cited by examiner

*Primary Examiner* — Peter M. Cuomo
*Assistant Examiner* — Ifeolu A Adeboyejo
(74) *Attorney, Agent, or Firm* — Steven Rinehart

(57) ABSTRACT

A compact, lightweight beach towel assembly including a ground cover and circumscribing sidewall having an elastomeric band, the ground cover weighted with sand bags, optionally including flexible rods.

3 Claims, 5 Drawing Sheets

LIGHTWEIGHT, COMPACT, BEACH TOWEL ASSEMBLY

BACKGROUND

Field of the Invention

This invention relates to beach towels, and more particularly relates to a weighted beach accessory for covering a ground surface and providing a clean laying area for a sunbather or beach goer.

Description of the Related Art

Sunbathers and beach goers enjoy relaxing on flexible towels or mats which separate the sunbather from the sand. These towels, or mats, frequently blow away and do not typically cover a large enough surface area to give a sunbather a practical amount of space. For this reason, a variety of weights have been developed in the art used, which are cumbersome and must be ported with the towel.

Because personal items ported to a beach setting must be carried by hand, often by a beach goer is wearing sandals or uncomfortable footwear in conjunction with heavier items such as coolers, it is important that towels and beach accessories be as lightweight and compact as possible.

While weighted towels are known in the art, they have proven to have little commercial viability because of the difficult of porting the weights. For this reason, other art has become known, including towels with sand anchors which are screwed or hammered into the sand to hold down the beach towel. These items also suffer from defects in that the anchors and components necessary to assemble and hold the towel are also cumbersome, expensive and easily lost.

There exist no towels in the art which are lightweight and portable and which solve the various aforescribed problems with the art. There is a need in the art for an portable, lightweight beach towel which overcomes these shortcomings in the art.

SUMMARY

From the foregoing discussion, it should be apparent that a need exists for a lightweight, compact beach towel. Beneficially, such a device would overcome inefficiencies with the prior art by providing a towel which is inexpensive to fabricate and easily to port, stow and use.

The present invention has been developed in response to the present state of the art, and in particular, in response to the problems and needs in the art that have not yet been fully solved by currently available apparti. Accordingly, the present invention has been developed to provide a compact beach towel assembly comprising: a flexible ground cover; an uninterrupted sidewall circumscribing an exterior perimeter of the flexible ground cover, a bottom edge of the sidewall connected directly to the perimeter of the ground cover; wherein the uninterrupted sidewall defines one or more hollow pockets circumscribing an upper edge of the sidewall; an elastic band circumscribing the upper edge of the sidewall within the hollow pockets; a plurality of bags adapted to hold sand, each bag positioned on a corner of the ground cover, wherein each bag comprises a plurality of tie strings, each bag applying tensile force to the sidewall and holding the sidewall in place laterally and vertically using a friction fit.

The flexible ground cover may be one of square, rectangular, triangular, hexagonal, octagonal and ovoid. The hollow pockets may not circumscribe corners of the sidewall but rather planar edges of the sidewall in some embodiments.

The elastic band may be stretched across corners of the ground cover from an open end of a first pocket to an open end of a second pocket forming a bag recess between the elastic band and a corner of the sidewall; and each bag is positioned in a bag recess such that the bag forms a friction fit with both the elastic band and the corner of the sidewall.

A second compact beach towel assembly is provided comprising: a flexible ground cover; an uninterrupted sidewall circumscribing an exterior perimeter of the flexible ground cover, a bottom edge of the sidewall connected directly to the perimeter of the ground cover, the uninterrupted sidewall forming a sunbathing recess with an open top end spanning the width of the ground cover; wherein the uninterrupted sidewall defines one or more hollow pockets circumscribing an upper edge of the sidewall.

The hollow pockets may not circumscribe corners of the sidewall but rather planar edges of the sidewall in various embodiments.

The compact beach towel assembly may further comprise a plurality of flexible rods inserted into the pockets.

The elastic band may be stretched across corners of the ground cover from an open end of a first pocket to an open end of a second pocket forming a bag recess between the elastic band and a corner of the sidewall; each bag is positioned in a bag recess such that the bag forms a friction fit with both the elastic band and the corner of the sidewall; an elastic band circumscribing the upper edge of the sidewall within the hollow pockets; a plurality of bags adapted to hold sand, each bag positioned on a corner of the ground cover, wherein each bag comprises a plurality of tie strings, each bag applying tensile force to the sidewall and holding the sidewall in place laterally and vertically using a friction fit.

The flexible ground cover may be one of square, rectangular, triangular, hexagonal, octagonal and ovoid.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1:
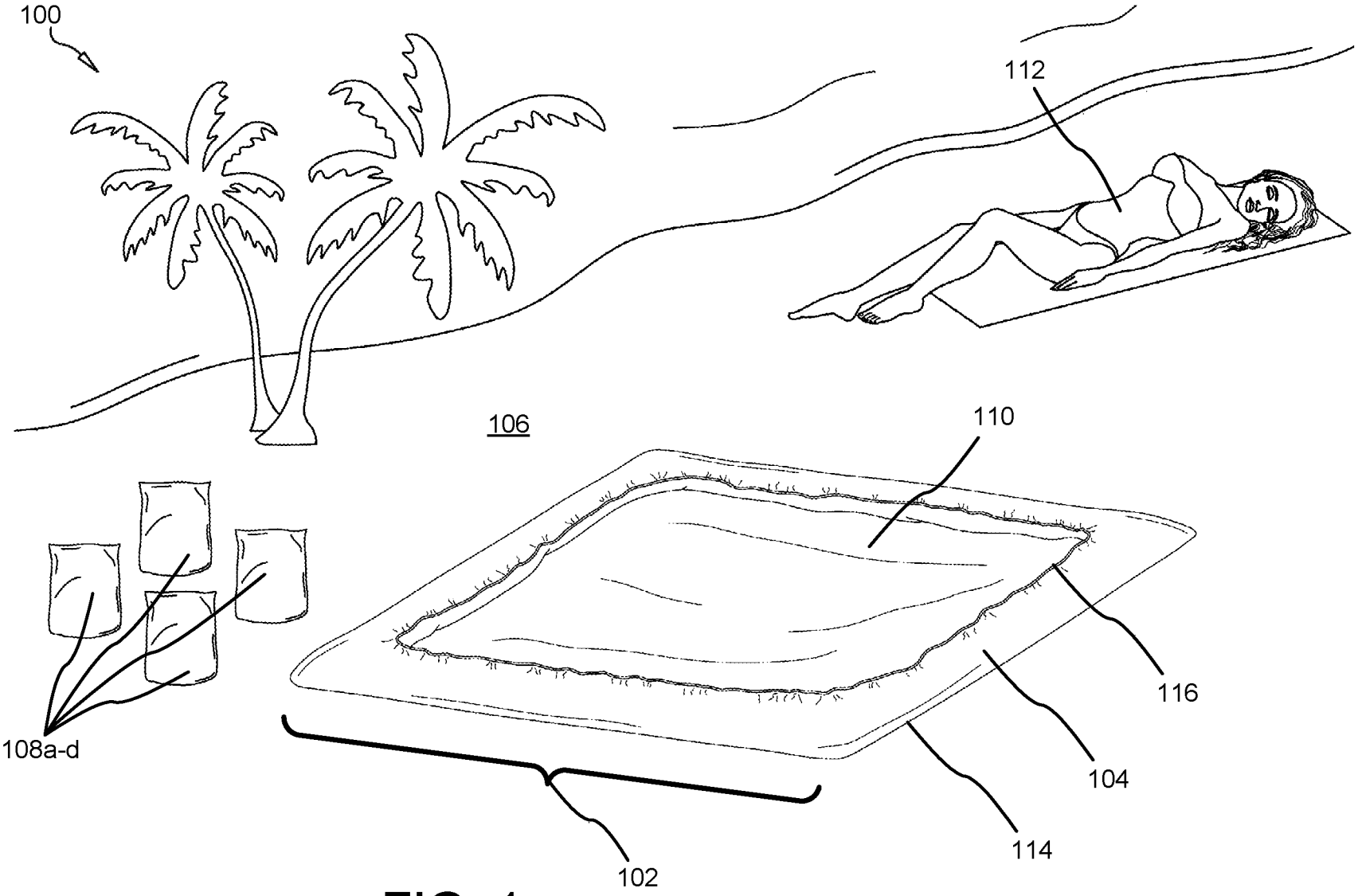
FIG. 1 is an environmental, side perspective view of a lightweight, compact beach towel assembly in accordance with the present invention.

FIG. 1 is an environmental, side perspective view of a lightweight, compact beach towel assembly 100 in accordance with the present invention.

The ground cover 102 comprises a cloth or flexible textile forming a square or rectangle as shown, but alternatively shaped circularly or polygonially. The ground cover 102 may be fabricated from woven materials such as linen, cotton or silk, or polymeric materials known to those of skill in the art.

The ground cover comprises an uninterrupted sidewall 104 which circumscribes the perimeter of the ground cover 102. The sidewall 104 may be formed from the same woven material as the ground cover 102. In various embodiments, the sidewall 104 comprises a square or rectangular lower edge 114 which joins and circumscribes an outer edge of the ground cover 102 while comprises a circular or ovoid upper edge 116.

The ground cover 102 is adapted to lay on a sand surface and to contour the underlying sand surface 106, helping prevent sand from contaminating a laying area for a sunbather 112 defined by and above the ground cover 102 and within the sidewall 104.

A plurality of bags 108 are included in the assembly 100. The bags 108 are adapted to hold sand from the sand surface 106. The bags 108 are lightweight and filled with sand when the apparatus 100 is assembled on the sand surface 106. The bags 108 are further described below in relation to FIG. 5. In typical embodiments, the assembly 100 comprises four bags, but may comprise only three (in embodiments in which the ground cover 102 is triangular for instance), or many (in embodiments where the ground cover 102 is hexagonal, octagonal, or polygonal).

Figure 2:
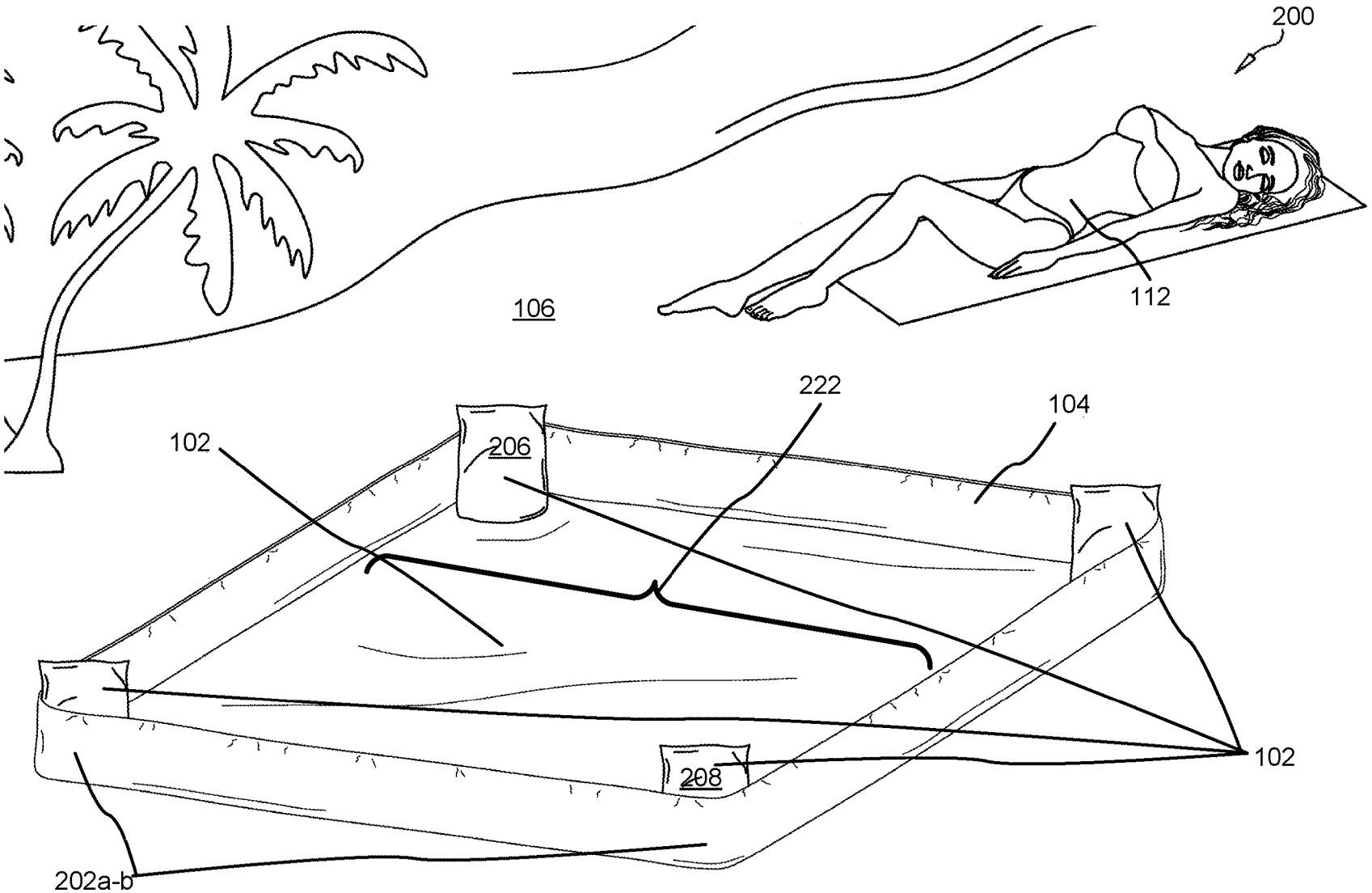
FIG. 2 is an environmental, side perspective view of a lightweight, compact beach towel assembly in accordance with the present invention.

FIG. 2 is an environmental, side perspective view of a lightweight, compact beach towel assembly 200 in accordance with the present invention.

In various embodiments, the bags 108 are disposed in the corners 202 of the ground cover 102 such that the bags 108, when weighted with sand, press the sidewall 104 outwardly, the bags 108 forming pillars which support laterally and vertically the sidewall 104, holding the sidewall 104 in position around and superiorly to the ground cover 102. The sidewalls 104 keep sand from blowing or being pressed onto the top surface of the ground cover 102 where the sunbather 112, or a plurality of sunbathers 112, are resting.

In various embodiments, the ground cover 102 and sidewalls 104 are formed as a single integrated piece.

The sidewall 104, the bags 108 when weighted and positioned, and the ground cover 102 together define a sunbathing recess 222 which spans the dimensions of the ground cover 102, including width and breadth.

Figure 3:
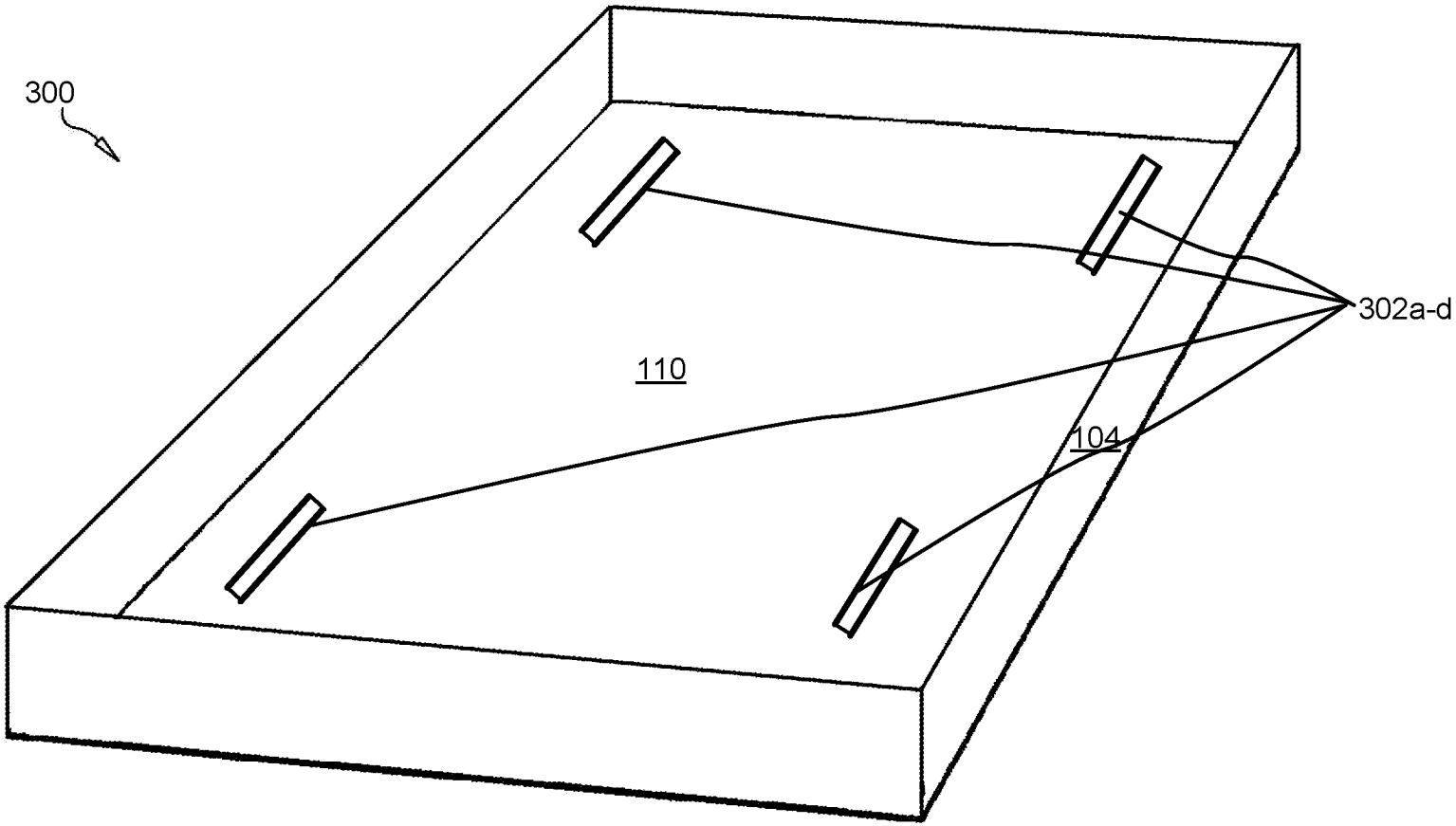
FIG. 3 is an isometric perspective view of a lightweight, compact beach towel assembly in accordance with the present invention.

FIG. 3 is an isometric perspective view of a lightweight, compact beach towel assembly 300 in accordance with the present invention.

In some embodiments, the sidewall 104 is supported, or partially supported, by one or more rods 408 without bags 108. In some embodiments, an upper surface 110 of the ground cover comprises a plurality of handles 302*a-d*. These handles 302 may disposed at corners of the ground cover or centrically thereto, and may affix to straps 508 further described below.

Figure 4:
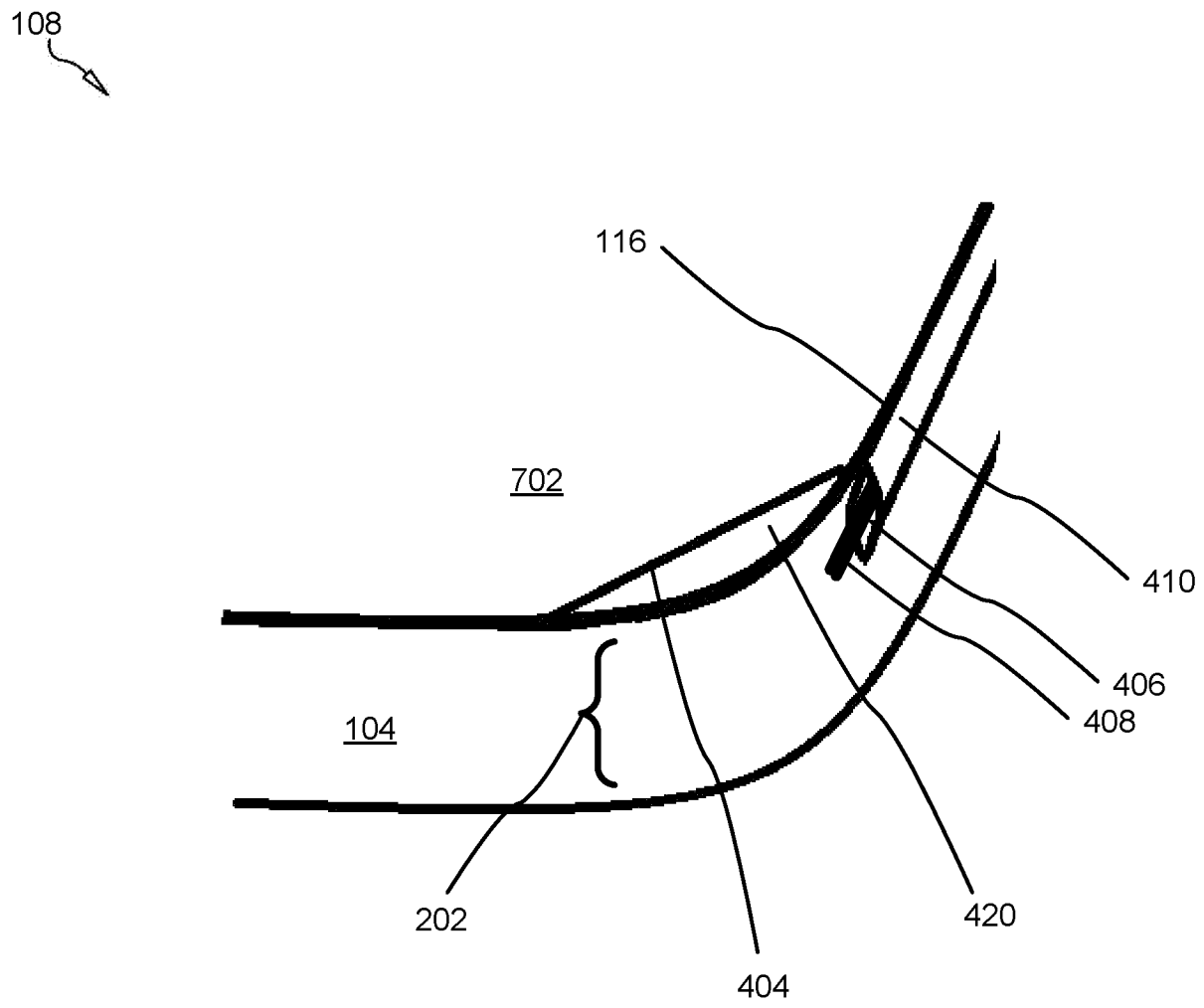
FIG. 4 is an exploded side perspective view of the corner of a lightweight, compact beach towel assembly in accordance with the present invention.

FIG. 4 is an exploded side perspective view of a lightweight, compact beach towel assembly 400 in accordance with the present invention.

In various embodiments, the top edge 116 of the sidewall 104 folds over itself to form a pocket 406 into which a flexible rod 408 is inserted to provide support to for the sidewall 104.

An uninterrupted elastic band 404 circumscribes the top edge 116 of the sidewall 104. The elastic band 404 may position within the pocket 406. The pocket 406 may open up at the corners 202 to allow the elastic band 404 to cut across the corner 202 in hypotenuse-like manner above the ground cover 102. In this embodiment, the elastic band 404 at the corner of the assembly 400, may form a recess 420 in the corner 202 of the assembly 400 into which a bag 108 in inserted such that the elastic band 404 stretches around at interior surface 206 of the bag 108 at the corner 202 while the sidewall 104 is stretched around an exterior surface 208 of the bag 108.

A plurality of pockets 406 may circumscribe only planar edges of the sidewall 104, the pockets having open ends as shown which one or more rods 408 and/or elastic bands 404 are inserted.

Figure 5:
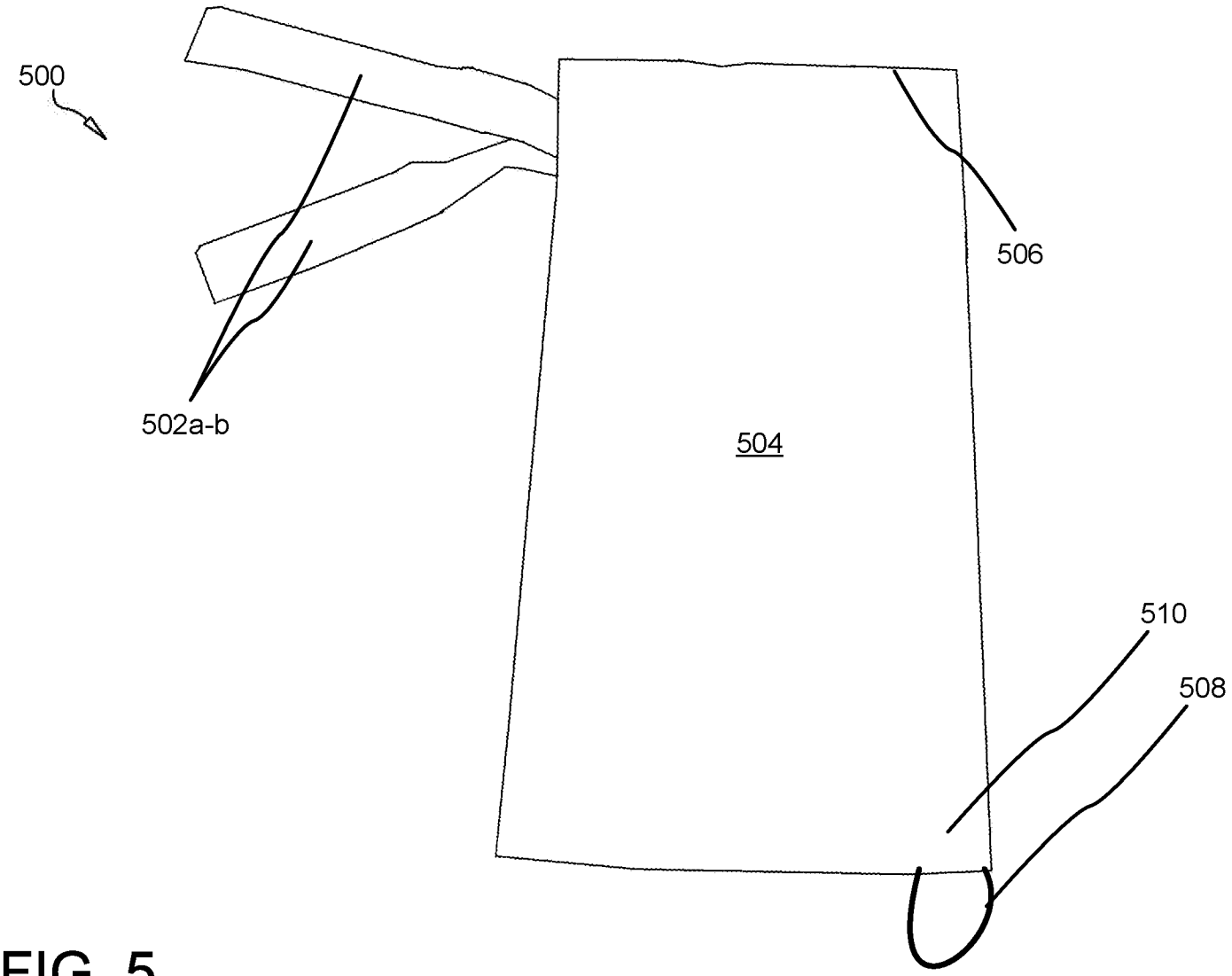
FIG. 5 is a side perspective view of a bag of a lightweight, compact beach towel assembly in accordance with the present invention.

FIG. 5 is a side perspective view of a bag 108 of a lightweight, compact beach towel assembly 100 in accordance with the present invention.

The bag 108 comprises a main body 504 which may comprise two textile pieces sewn together or a single textile piece folded over itself on one edge and sewn together on two, or be formed of other means known to those of skill in the art. The main body 504 defines an open top end 506 in which sand is placed. The bag 108 may comprise two to four straps 502 which are tied together to hold the sand inside the bag 108.

In various embodiments, the ties 502 are tied to the elastic band 404 at the corner 202 to hold the weighted bag 108 in place on the cover 102. A strap 508 may be connected to the main body 504, which strap 508 may interconnect with a handle 302 using means known to those of skill in the art, including tying or loop-hook fasteners. The main body 504 may comprise a plurality of straps 508, each connected at a corner 510 of the main body.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A compact beach towel assembly comprising:

a flexible ground cover;

an uninterrupted sidewall circumscribing an exterior perimeter of the flexible ground cover, a bottom edge of the sidewall connected directly to the perimeter of the ground cover;

wherein the uninterrupted sidewall defines one or more hollow pockets circumscribing an upper edge of the sidewall;

an elastic band circumscribing the upper edge of the sidewall within the hollow pockets;

a plurality of bags adapted to hold sand, each bag positioned on a corner of the ground cover, wherein each bag comprises a plurality of tie strings, each bag applying tensile force to the sidewall and holding the sidewall in place laterally and vertically using a friction fit.

2. The compact beach towel assembly of claim 1, wherein the flexible ground cover is one of square, rectangular, triangular, hexagonal, octagonal and ovoid.

3. The compact beach towel assembly of claim 1, wherein the hollow pockets do not circumscribe corners of the sidewall but rather planar edges of the sidewall.

* * * * *